US008698588B2

(12) United States Patent
Park et al.

(10) Patent No.: US 8,698,588 B2
(45) Date of Patent: Apr. 15, 2014

(54) TRANSFORMER

(75) Inventors: Geun Young Park, Gyunggi-do (KR); Sang Joon Seo, Gyunggi-do (KR); Deuk Hoon Kim, Gyunggi-do (KR); Hwi Beom Shin, Gyeongsangnam-do (KR); Young Min Lee, Gyunggi-do (KR); Jong Hae Kim, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 38 days.

(21) Appl. No.: 13/175,471

(22) Filed: Jul. 1, 2011

(65) Prior Publication Data

US 2012/0001713 A1 Jan. 5, 2012

(30) Foreign Application Priority Data

Jul. 2, 2010 (KR) ..... 10-2010-0063720
Sep. 20, 2010 (KR) ..... 10-2010-0092703

(51) Int. Cl.
*H01F 27/30* (2006.01)
*H01F 27/29* (2006.01)
*H01F 27/28* (2006.01)

(52) U.S. Cl.
USPC ..... 336/198; 336/192; 336/196; 336/208; 336/220; 336/222

(58) Field of Classification Search
USPC ..... 336/192, 196, 198, 208, 220, 222
See application file for complete search history.

(56) References Cited

U.S. PATENT DOCUMENTS 3,652,968 A 3/1972 Johnston et al.
3,946,350 A 3/1976 Goto
3,958,328 A 5/1976 Lee (Continued)

FOREIGN PATENT DOCUMENTS

CN 1514424 A 7/2004
GB 2112746 A * 7/1983

(Continued)

OTHER PUBLICATIONS

Korean Office Action, w/ English translation thereof, issued in Korean Patent Application No. 10-2010-0092703, dated Nov. 29, 2011.

(Continued)

*Primary Examiner* — Tsz Chan
(74) *Attorney, Agent, or Firm* — McDermott Will & Emery LLP

(57) ABSTRACT

There is provided a thin transformer capable of being used in a thin display device such as a liquid crystal display (LCD) device and a light emitting diode (LED) display device. The transformer includes: a bobbin part including a plurality of bobbins, each including a pipe shaped body part having a though-hole formed in an inner portion thereof, a flange part vertically protruding outwardly from both ends of the body part, and a terminal connection part protruding from one side of a lower flange part formed at a lower end of the body part and having external connection terminals connected thereto; a core inserted into the through-hole of the bobbin to thereby form a magnetic path; and a coil part including coils each wound around the plurality of bobbins, wherein the bobbin part includes an outer bobbin and an inner bobbin inserted into the through-hole of the outer bobbin to thereby be coupled thereto, and the terminal connection part of the inner bobbin protrudes in an outer diameter direction thereof.

8 Claims, 9 Drawing Sheets

(56) References Cited

U.S. PATENT DOCUMENTS

| | | | | | |
|---|---|---|---|---|---|
| 4,250,479 | A | | 2/1981 | Bausch et al. | |
| 4,596,974 | A | | 6/1986 | Tobben et al. | |
| 4,857,878 | A | | 8/1989 | Eng, Jr. et al. | |
| 4,967,121 | A | | 10/1990 | Nero | |
| 5,534,839 | A | | 7/1996 | Mackin et al. | |
| 5,673,013 | A | * | 9/1997 | Moody et al. | 336/192 |
| 5,726,616 | A | | 3/1998 | Bell | |
| 5,996,214 | A | | 12/1999 | Bell | |
| 6,046,663 | A | | 4/2000 | Kubomura et al. | |
| 6,127,912 | A | * | 10/2000 | Dust et al. | 336/208 |
| 6,344,786 | B1 | | 2/2002 | Chin | |
| 6,611,189 | B2 | | 8/2003 | Sigl | |
| 6,900,717 | B2 | | 5/2005 | Timashov et al. | |
| 8,018,314 | B2 | | 9/2011 | Zeng et al. | |
| 2003/0030531 | A1 | | 2/2003 | Okano et al. | |
| 2004/0125065 | A1 | | 7/2004 | Park et al. | |
| 2005/0275498 | A1 | | 12/2005 | Haga | |
| 2006/0255898 | A1 | | 11/2006 | Sawazaki et al. | |
| 2007/0273466 | A1 | | 11/2007 | Yang et al. | |
| 2008/0180205 | A1 | | 7/2008 | Tsai et al. | |
| 2009/0237195 | A1 | * | 9/2009 | Zeng et al. | 336/196 |

FOREIGN PATENT DOCUMENTS

| | | | | |
|---|---|---|---|---|
| JP | 61-140515 | | | 8/1986 |
| JP | 62005622 | A | | 1/1987 |
| JP | 63-170915 | | | 11/1988 |
| JP | 1156523 | U | | 10/1989 |
| JP | 03284807 | A | * | 12/1991 |
| JP | 05-038845 | | | 2/1993 |
| JP | 7-022526 | A | | 7/1993 |
| JP | 5-66935 | U | | 9/1993 |
| JP | 05283248 | A | | 10/1993 |
| JP | 5-304033 | A | | 11/1993 |
| JP | 5-90928 | U | | 12/1993 |
| JP | 06-013124 | | | 1/1994 |
| JP | 6-112058 | A | | 4/1994 |
| JP | 06-295828 | | | 10/1994 |
| JP | 07-106158 | | | 4/1995 |
| JP | 08-069928 | A | | 3/1996 |
| JP | 08-153630 | A | | 6/1996 |
| JP | 09-129457 | | | 5/1997 |
| JP | 2569842 | | | 2/1998 |
| JP | 2001-250728 | | | 9/2001 |
| JP | 2001-305972 | A | | 11/2001 |
| JP | 2001-350133 | A | | 12/2001 |
| JP | 2002-313641 | A | | 10/2002 |
| JP | 3454801 | | | 7/2003 |
| JP | 2005-158927 | | | 6/2005 |
| JP | 2009-117660 | | | 5/2009 |
| KR | 10-2006-0035561 | A | | 4/2006 |

OTHER PUBLICATIONS

United States Office Action issued in U.S. Appl. No. 13/175,438 dated Aug. 16, 2012.

U.S. Office Action issued in U.S. Appl. No. 13/175,660, mailed on Oct. 16, 2012.

United States Office Action issued in U.S. Appl. No. 13/175,290 mailed on Feb. 14, 2013.

United States Office Action issued in U.S. Appl. No. 13/175,438 mailed on Feb. 19, 2013.

United States Office Action issued in U.S. Appl. No. 13/175,678 mailed on Feb. 25, 2013.

United States Office Action issued in U.S. Appl. No. 13/175,640 mailed on Jan. 30, 2013.

Office Action issued in Japanese Patent Application No. 2011-147753 dated May 7, 2013.

Japanese Office Action for Patent Application No. 2011-147692 and English abstract dated Mar. 5, 2013.

Japanese Office Action for Patent Application No. 2011-147586 and English abstract dated Mar. 5, 2013.

Office Action issued in U.S. Appl. No. 13/175,438 dated Jun. 6, 2013.

Chinese Office Action, w/ English translation thereof, issued in Chinese Patent Application No. CN 201110191334.8 dated Oct. 12, 2013.

United States Office Action issued in U.S. Appl. No. 13/175,632 dated Aug. 9, 2013.

* cited by examiner

TRANSFORMER

CROSS-REFERENCE TO RELATED APPLICATIONS

This application claims the priority of Korean Patent Application Nos. 10-2010-0063720 filed on Jul. 2, 2010 and 10-2010-0092703 filed on Sep. 20, 2010, in the Korean Intellectual Property Office, the disclosures of which are incorporated herein by reference.

BACKGROUND OF THE INVENTION

1. Field of the Invention

The present invention relates to a thin transformer capable of being used in a thin display device such as a liquid crystal display (LCD) device or a light emitting diode (LED) display device.

2. Description of the Related Art

Recently, a flat panel display (FPD), a new technology appropriate for a multi-media system having a high resolution and a large-sized screen or the like, has been prominent in the field of displays, instead of a cathode ray tube (CRT).

Particularly, a thin display device such as a liquid crystal display (LCD) TV or a plasma display panel (PDP) TV has been prominent as a large-sized display. In the future, it is expected that the thin display device will continuously receive attention in view of the cost and marketability thereof.

A cold cathode fluorescent lamp (CCFL) has been used as a backlight light source in the LCD TV. However, the use of a light emitting diode (LED) has recently been gradually increased due to various advantages in terms of power consumption, life span, environmental friendliness, and the like.

In accordance with the use of the LED, a backlight unit has been miniaturized. As a result, a thickness of a flat TV has gradually been reduced. In addition, the demand for slimness in a power supply module within the flat TV has also increased.

Meanwhile, significant manpower is required to produce the transformer according to the related art as the majority of a production process thereof is manually performed. Therefore, there are limitations in increasing productivity or securing quality.

SUMMARY OF THE INVENTION

An aspect of the present invention provides a thin transformer capable of being easily used in a thin display device, or the like.

Another aspect of the present invention provides a transformer capable of being automatically produced.

Another aspect of the present invention provides a transformer capable of being easily mounted on a substrate.

According to an aspect of the present invention, there is a transformer including: a bobbin part including a plurality of bobbins, each including a pipe shaped body part having a though-hole formed in an inner portion thereof, a flange part vertically protruding outwardly from both ends of the body part, and a terminal connection part protruding from one side of a lower flange part formed at a lower end of the body part and having external connection terminals connected thereto; a core inserted into the through-hole of the bobbin to thereby form a magnetic path; and a coil part including coils each wound around the plurality of bobbins, wherein the bobbin part includes an outer bobbin and an inner bobbin inserted into the through-hole of the outer bobbin to thereby be coupled thereto, and the terminal connection part of the inner bobbin protrudes in an outer diameter direction thereof.

The terminal connection part of the inner bobbin may protrude by a length corresponding to a width of the flange part of the outer bobbin.

The inner bobbin may be inserted into the through-hole of the outer bobbin to thereby be coupled thereto such that the flange part of the inner bobbin and the flange part of the outer bobbin are disposed on the same plane.

At least one of the plurality of bobbins may include the flange part having a width larger than a thickness of the body part.

Each of the terminal connection parts respectively included in the inner and outer bobbins may include a lead groove formed in a space between the external connection terminals, and the coils may lead to a lower portion of the bobbin part while passing through the lead groove.

The inner bobbin may be coupled to the outer bobbin such that the external connection terminals of the inner bobbin and the external connection terminals of the outer bobbins are opposed.

The terminal connection part may include guide protrusions formed on a lower surface thereof and protruding in parallel with the external connection terminals, and lead wires of the coils may be disposed along the guide protrusions to thereby be connected to the external connection terminals.

At least one of the lead wires of the coils may be connected to the external connection terminals through a space between two adjacent guide protrusions.

The terminal connection part of the outer bobbin may include a spacing block formed between the guide protrusions and the inner bobbin and protruding perpendicular to the guide protrusions.

The coil part may include a primary coil wound around the inner bobbin and a secondary coil wound around the outer bobbin, and at least one of the primary and secondary coils may include a plurality of coils electrically insulated from each other.

The bobbin part may further include at least one intermediate bobbin interposed between the inner and outer bobbins.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1A:
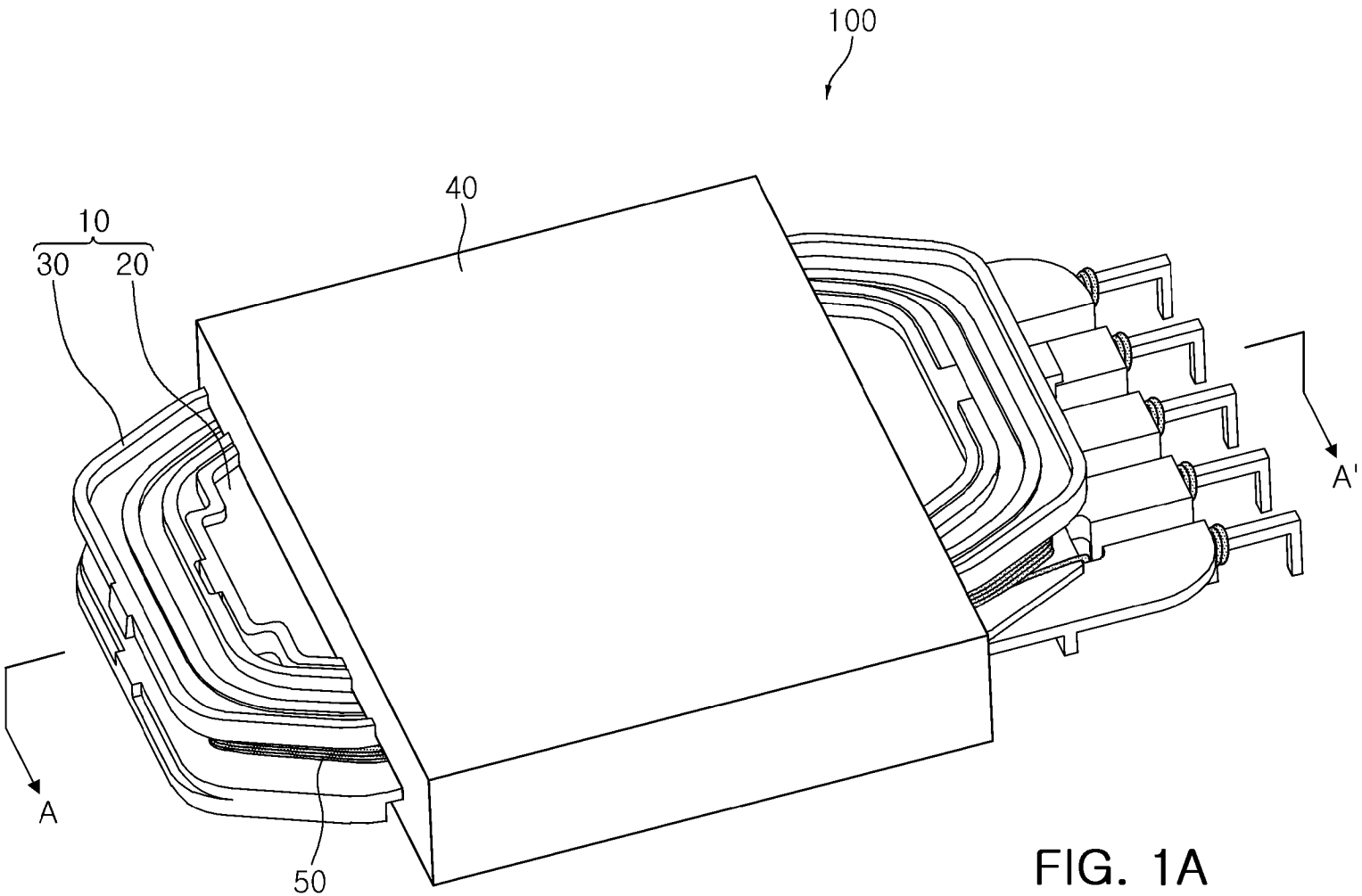
FIGS. 1A and 1B are schematic perspective views showing a transformer according to an embodiment of the present invention.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe most appropriately the best method he or she knows for carrying out the invention. Therefore, the configurations described in the embodiments and drawings of the present invention are merely the most preferable embodiments, but do not represent all of the technical spirit of the present invention. Thus, the present invention should be construed as including all the changes, equivalents, and substitutions included in the spirit and scope of the present invention at the time of filing this application.

Hereinafter, embodiments of the present invention will be described in detail with reference to the accompanying drawings. At this time, it is noted that like reference numerals denote like elements in appreciating the drawings. Moreover, detailed descriptions related to well-known functions or configurations will be ruled out in order not to unnecessarily obscure the subject matter of the present invention. Based on the same reason, it is to be noted that some components shown in the drawings are exaggerated, omitted or schematically illustrated, and the size of each component does not exactly reflect its real size.

Figure 1B:
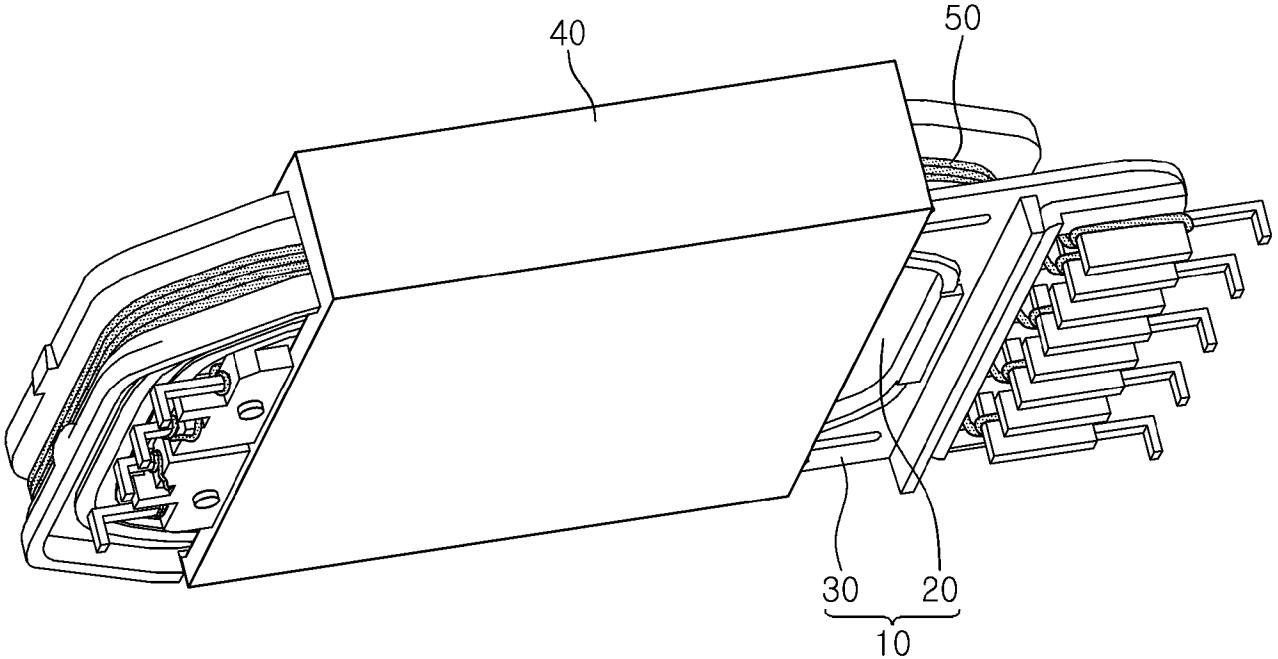
Figure 2:
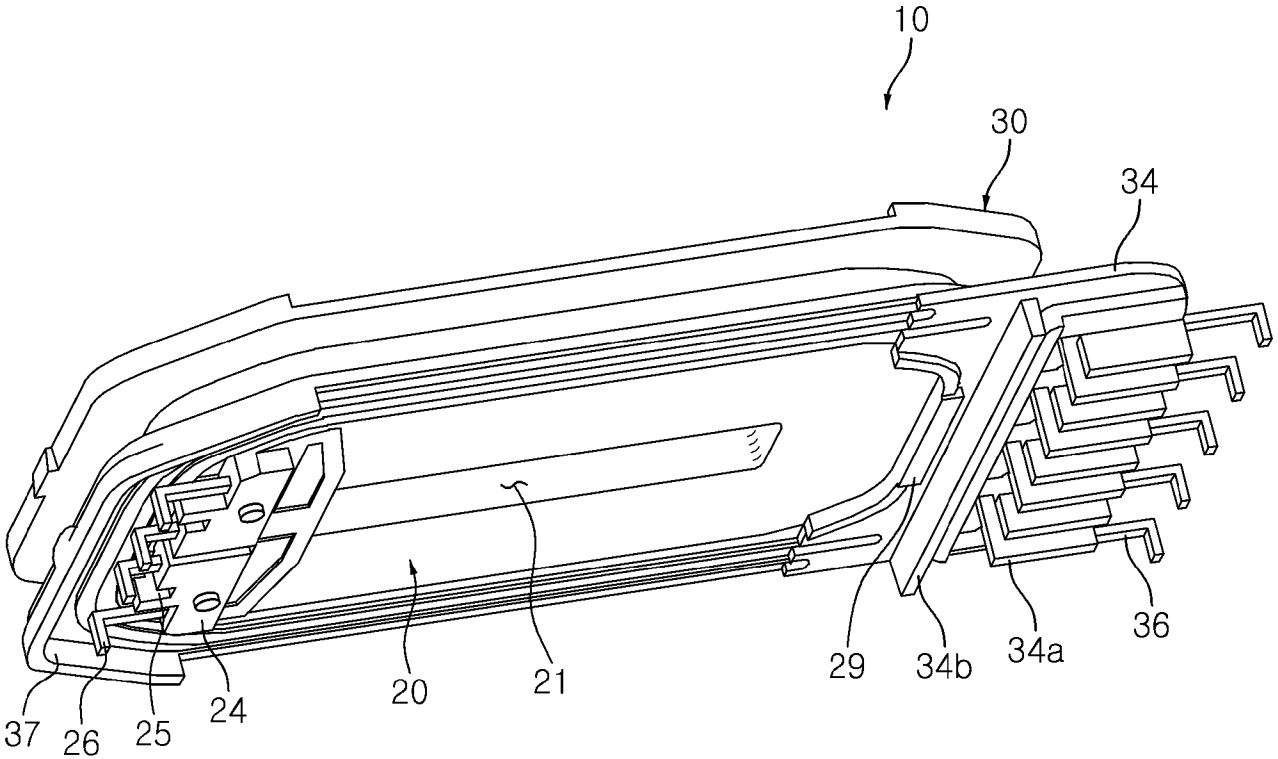
FIG. 2 is a schematic perspective view showing a bobbin part of the transformer shown in FIG. 1B.
Figure 3:
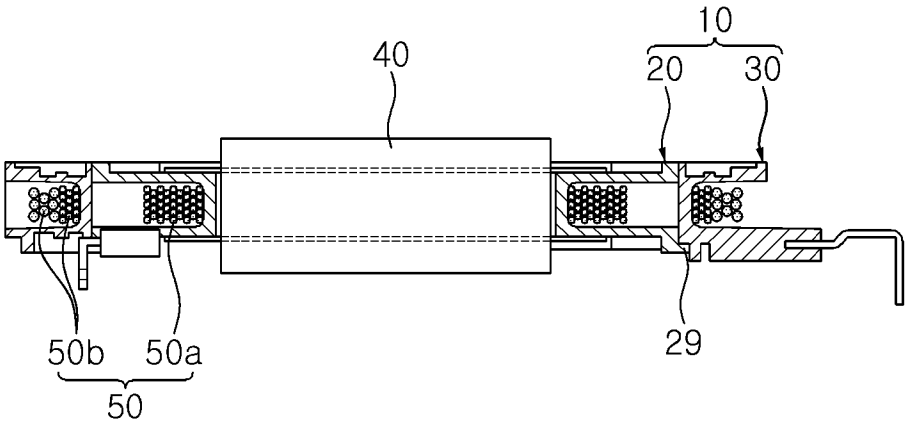
FIG. 3 is a cross-sectional view taken along line A-A' of the transformer shown in FIG. 1A.

FIGS. 1A and 1B are schematic perspective views showing a transformer according to an embodiment of the present invention; FIG. 2 is a schematic perspective view showing a bobbin part of the transformer shown in FIG. 1B; and FIG. 3 is a cross-sectional view taken along line A-A' of the transformer shown in FIG. 1A.

Figure 4:
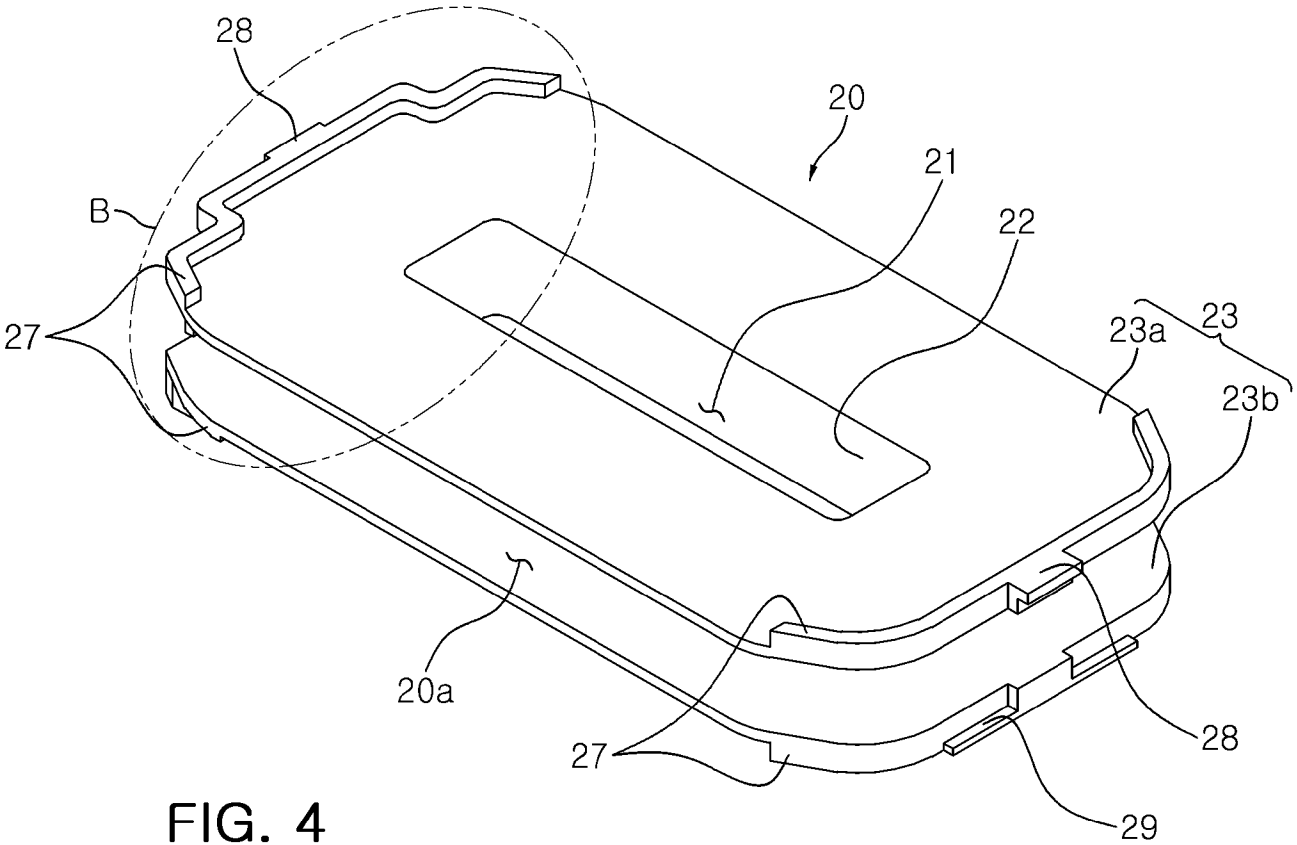
FIG. 4 is a schematic perspective view showing an inner bobbin of the transformer shown in FIG. 1.
Figure 5:
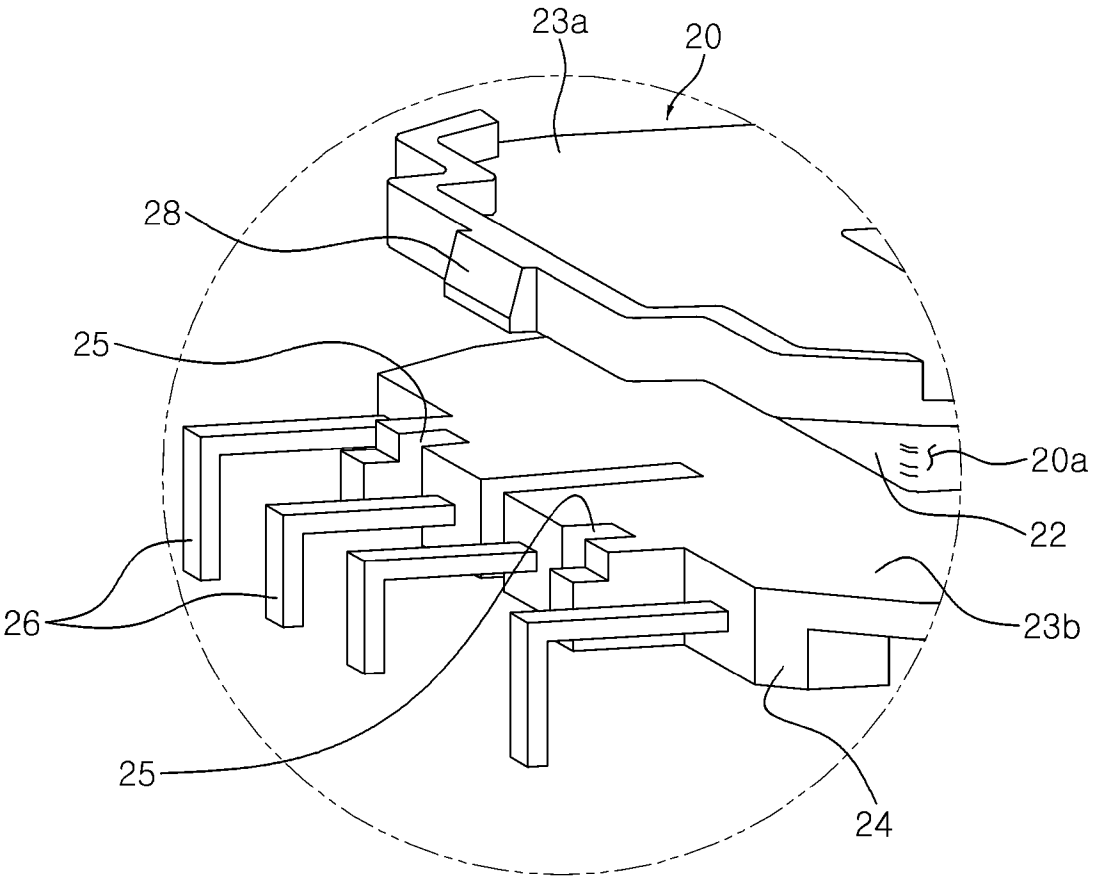
FIG. 5 is a partially enlarged perspective view showing part B of FIG. 4 at another angle.
Figure 6:
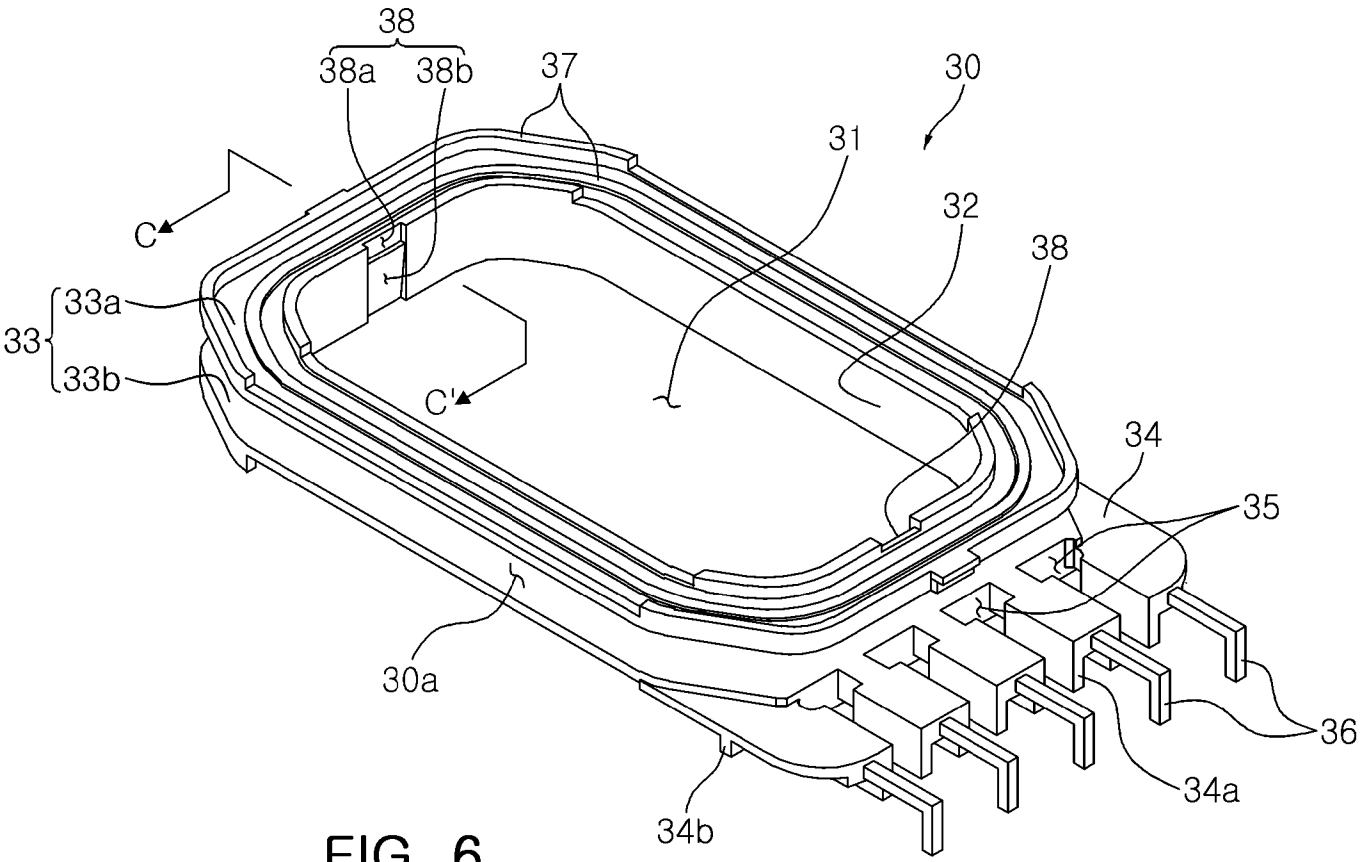
FIG. 6 is a schematic perspective view showing an outer bobbin of the transformer shown in FIG. 1.
Figure 7:
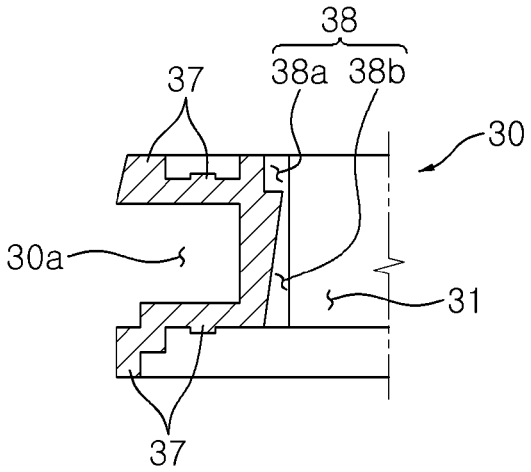
FIG. 7 is a cross-sectional view taken along line C-C' of the outer bobbin shown in FIG. 6.

FIG. 4 is a schematic perspective view showing an inner bobbin of the transformer shown in FIG. 1A; FIG. 5 is a partially enlarged perspective view showing part B of FIG. 4 at another angle; FIG. 6 is a schematic perspective view showing an outer bobbin of the transformer shown in FIG. 1; and FIG. 7 is a cross-sectional view taken along line C-C' of the outer bobbin shown in FIG. 6.

Referring to FIGS. 1A through 7, a transformer 100 according to an embodiment of the present invention includes a bobbin part 10, a coil part 50, and a core 40.

The bobbin part 10 includes an outer bobbin 30 and at least one inner bobbin 20.

The inner bobbin 20 includes a pipe shaped body part 22 having a through-hole 21 formed at the center of an inner portion thereof, a flange part 23 vertically extended from both ends of the body part 22 in an outer diameter direction thereof, external connection terminals 26 for electrical and physical connection to the outside, and a terminal connection part 24 having the external connection terminals 26 connected thereto, as shown in FIGS. 4 and 5.

The through-hole 21 formed in the inner portion of the body part 22 is used as a passage into which a portion of the core 40 to be described below is inserted. In the present embodiment, the through-hole 21 has a rectangular cross section by way of example. The cross sectional shape corresponds to a shape of the core 40 inserted into the through-hole 21. In the inner bobbin 20 according to the embodiment of the present invention, the through-hole 21 is not limited to having the above-mentioned shape but may have various shapes corresponding to shapes of the core 40 inserted thereinto.

The flange part 23 is divided into an upper flange part 23*a* and a lower flange part 23*b* according to a formation position thereof. In addition, a space between an outer peripheral surface of the body part 22 and the upper and lower flange parts 23*a* and 23*b* is used as an inner winding part 20*a* around which a coil 50 to be described below is wound. Therefore, the flange part 23 serves to protect the coil 50 from the outside and secure insulation properties between the coil 50 and the outside, while simultaneously supporting the coil 50 wound around the inner winding part 20*a* at both sides thereof.

Meanwhile, the flange part 23 according to the present embodiment has an inclined inner surface (that is, a surface forming the inner winding part). As a result, the flange part 23 has a reduced thickness in the outer diameter direction thereof. This configuration of the flange part is shown in FIG. 7. Although FIG. 7 shows a flange part 33 of the outer bobbin 30, the configuration in which the flange parts 22 and 33 have an inclined inner surface may be equally applied to both of the flange parts 23 and 33 of the inner and outer bobbins 20 and 30.

Since the inner winding part 20*a* of the inner bobbin 20 (or the outer bobbin 30) according to the present embodiment has a significantly deeper depth than that of an inner winding part of a bobbin of the related art transformer, a problem in which the bobbin part 10 is not easily separated from a mold during a process of manufacturing the bobbin part 10 may occur. Therefore, the above-mentioned configuration of the flange part 23 is provided in order to solve the problem.

In addition, in the transformer 100 according to the present embodiment, the flange part 23 has a width larger than a thickness of the bobbin part 10 (namely, the body part). This shape is provided because of the thinness of the transformer 100 according to the present embodiment. That is, the transformer 100 according to the present embodiment is an extremely thin transformer. For example, the transformer 100 including the external connection terminals 26 and 36 may have an overall vertical thickness of about 12 nm or less.

In order to secure an output voltage in the thin transformer 100 as described above, the inner bobbin 20 according to the present embodiment is formed such that the inner winding part 20*a* having the coil 50 wound therearound has a sufficient depth. That is, in the inner bobbin 20 according to the present embodiment, the width of the flange part 23 is larger than the thickness of the body part 22 (this configuration may also be equally applied to the outer bobbin). Here, the width of the flange part 23 means a horizontal distance from an inner peripheral edge of the through-hole 21 of the body part 22 to an outer peripheral edge of the flange part 23.

The lower flange part 23*b* of the inner bobbin 20 includes the terminal connection part 24 formed on one side thereof, and the terminal connection part 24 has the external connection terminals 26 connected thereto. The terminal connection part 24 protrudes downwardly from the lower flange part 23*b*, and may include at least one lead groove 25 to which a lead wire of the coil 50 wound around the inner winding part 20*a* leads.

The external connection terminals 26 are connected to the terminal connection part 24 and they protrude from the terminal connection part 24 in a downward direction or an outer diameter direction of the body part 22. Particularly, the external connection terminals 26 according to the present embodiment are connected to the terminal connection part 24 along an outer peripheral edge of the lower flange part 23*b*.

Meanwhile, in order to form the thin transformer 100, the flange part 23 provided in the inner bobbin 20 may have a maximally reduced thickness. However, the inner bobbin 20 according to the present embodiment is made of a resin material, which is an insulating material. Therefore, when the flange part 23 has an excessively reduced thickness, it does not maintain its shape, such that it may be bent. In addition, since the thickness of the flange part 23 according to the present embodiment is reduced in the outer diameter direction of the flange part 23, this problem is further intensified.

Therefore, the transformer 100 according to the present embodiment may include an insulating rib 27 formed on an outer surface of the flange part 23 in order to prevent the flange part 23 from being bent and reinforce the flange part 23. The insulating rib 27 may be formed on outer surfaces of the two flange parts 23*a* and 23*b* provided in the inner bobbin 20 or may be selectively formed on either outer surface thereof as needed.

In addition, since the transformer 100 according to the present embodiment is thin as described above, the insulating rib 27 may not excessively protrude from the flange part 23. Therefore, the insulating rib 27 according to the present embodiment protrudes vertically outwardly along the outer peripheral surface of the flange part 23 and has a thickness similar to that of the flange part 23. Due to the shape of the insulating rib 27 as described above, the transformer 100 according to the present embodiment may secure the strength of the flange part 23 while minimizing a protrusion distance of the insulating rib 27.

However, the present invention is not limited thereto but may be variously modified. For example, the protrusion distance of the insulating rib 27 may be set to correspond to a creepage distance, similar to an insulating rib 37 of the outer bobbin 30 to be described below.

In addition, although the accompanying drawings show a case in which only a single insulating rib 27 is formed along the outer peripheral edge of the flange part 23 on the inner bobbin 20, the insulating rib 27 may be additionally formed in order to further secure the strength of the flange part 23 or secure creepage distance. In this case, the additional insulating rib 27 may protrude in a ring shape along the shape of the flange part 23.

In addition, the insulating rib 27 according to the present embodiment is formed only at a portion at which the inner bobbin 20 does not face the core 40 to be described below. That is, the insulating rib 27 is formed along the outer peripheral surface of the flange part 23 exposed to the outside of the core 40. This is to increase adhesion between the bobbin and the core 40. However, the present invention is not limited thereto. That is, the insulating rib 27 may be formed along the entire outer peripheral edge of the flange part 23. In addition, various modifications may be made. For example, the insulating rib 27 may protrude more on the flange part 23 exposed to the outside of the core 40 and protrude less on the flange part 23 facing the inner surface of the core 40.

The flange part 23 of the inner bobbin 20 according to the present embodiment is coupled to the outer bobbin 30 to be described below. To this end, the flange part 23 includes at least one fitting protrusion 28 and a support jaw 29 formed on the outer peripheral edge thereof.

The fitting protrusions 28 are formed on the outer peripheral edges of the upper flange part 23*a* and protrude from both distal ends of the outer peripheral edges maximally spaced apart from each other in the outer diameter direction of the flange part 23*a*, respectively. Here, the fitting protrusion 28 may also protrude from the insulating rib 27.

The support jaw 29 is formed on the lower flange part 23*b* at a position corresponding to the position at which the fitting protrusion 28 is formed. More specifically, the support jaw 29 protrudes from the insulating rib 27 formed on the lower flange part 23*b*. In the case of the present embodiment, the terminal connection part 24 may also serve as the support jaw 29. Therefore, the support jaw 29 may be formed only on a side of the lower flange part 23*b* on which the terminal connection part 24 is not formed.

As described above, since the fitting protrusion 28 and the support jaw 29 are formed on the upper flange part 23*a* and the lower flange part 23*b*, respectively, when the inner bobbin 20 is coupled to the outer bobbin 30 to be described below, it is not easily separated from the outer bobbin 30. A detailed description thereof will be provided in a description of the outer bobbin 30 to be described below.

The fitting protrusion 28 according to the present embodiment is not limited to the above-mentioned configuration but may be variously modified. For example, a plurality of fitting protrusions 28 may be formed at various positions on the outer peripheral edge of the flange part 23.

The outer bobbin 30 has a similar shape to that of the inner bobbin 20 and has a similar thickness to that of the inner bobbin 20; however, it has a different size therefrom, as shown in FIGS. 6 and 7.

The outer bobbin 30 includes a pipe shaped body part 32 having a through-hole 31 formed at the center of an inner portion thereof, a flange part 33, a terminal connection part 34, and external connection terminals 36, similar to those of the inner bobbin 20. Therefore, a detailed description of configurations of the outer bobbin 30 the same as those of the inner bobbin 20 will be omitted, and only a detailed description of configurations of the outer bobbin 30 different therefrom will be provided.

The through-hole 31 formed in the inner portion of the body part 32 is used as a space into which the inner bobbin 20 is inserted. Therefore, the through-hole 31 formed in the outer bobbin 30 has a shape corresponding to that of the outer peripheral edge of the flange part 23 of the inner bobbin 20.

In addition, a space formed between an outer peripheral surface of the body part 32 of the outer bobbin 30 and the flange part 33 is used as an outer winding part 30*a* around which the coil 50 to be described below is wound.

Similar to the lower flange part 23*b* of the inner bobbin 20, a lower flange part 33*b* of the outer bobbin 30 includes the terminal connection part 34 formed on one side thereof, and the terminal connection part 34 has the external connection terminals 36 connected thereto.

The terminal connection part 34 protrudes from the lower flange part 33*b* in an outer diameter direction of the body part 32, and includes guide protrusions 34*a*, lead grooves 35, and a spacing block 34*b*.

A plurality of guide protrusions 34*a* protrude from a lower surface of the terminal connection part 34 downwardly of the body part 32 in parallel with each other. The guide protrusion 34*a* is provided to guide a lead wire of the coil 50 wound around the outer winding part 30*a* so that the lead wire may be easily connected to the external connection terminal 36. Therefore, the guide protrusion 34*a* may protrude beyond a diameter of the lead wire of the coil 50 so as to firmly guide the coil 50.

The lead groove 35 is formed in a space between the guide protrusions 34*a*, and is used as a route through which the lead wire of the coil 50 wound around the outer winding part 30*a* moves to the lower surface of the terminal connection part 34.

Due to the configuration of the terminal connection part 34 as described above, the lead wire of the coil 50 wound around the outer winding part 30*a* moves to a lower portion of the outer bobbin 30 while passing through the lead groove 35 and is then electrically connected to the external connection terminal 36 through the space between the guide protrusions 34*a* disposed adjacent to each other.

The spacing block 34*b* is used to secure a creepage distance between the external connection terminal 36 and the inner bobbin 20. To this end, the spacing block 34*b* protrudes between the guide protrusion 34*a* and the inner bobbin 20 in a direction perpendicular to a direction in which the guide protrusion 34*a* is disposed.

The external connection terminals 36 are connected to the terminal connection part 34 and they protrude from a distal end of the terminal connection part 34 in a downward direction or the outer diameter direction of the body part 32.

In addition, similar to the inner bobbin 20, the outer bobbin 30 also includes the flange part 33 having a width larger than the thickness of the body part 32. Therefore, at least one insulating rib 37 may be provided on the flange part 33 in order to prevent the flange part 33 from being bent and secure the strength of the flange part 33.

Here, the insulating rib 37 formed on the outer bobbin 30 may be formed in plural, similar to the case of the inner bobbin 20. In addition, the insulating rib 37 protrudes by a distance through which a creepage distance may be secured between the coil 50 wound around the outer bobbin 30 and the coil 50 wound around the inner bobbin 20 while the strength of the flange part 33 is maintained.

A detailed description thereof will be provided below.

As shown in FIG. 3, when the inner bobbin 20 and the outer bobbin 30 are coupled to each other, a creepage distance between a primary coil 50*a* wound around the inner bobbin 20 and a secondary coil 50*b* wound around the outer bobbin 30 is formed along an outer surface of the flange part 33 of the outer bobbin 30.

Therefore, in the transformer 100 according to the present embodiment, the insulating rib 37 is used in order to secure a creepage distance while minimizing the size of the outer bobbin 30. That is, the number and protrusion distance of the insulating ribs 37 are controlled to thereby secure the creepage distance between the coil 50 wound around the inner bobbin 20 and the coil 50 wound around the outer bobbin 30.

Here, in the case in which the flange part 23 of the inner bobbin 20 is extended to have a sufficient length, an empty space having a predetermined interval may be formed between an outer surface of the primary coil 50*a* wound around the inner winding part 20*a* and an inner peripheral surface of the outer bobbin 30. In this case, a distance between the primary coil 50*a* and the secondary coil 50*b* is further secured, and accordingly, even in a case that only a single insulating rib 37 is provided, the creepage distance may be secured. This may be equally applied to a case in which the flange part 33 of the outer bobbin 30 is extended to have a sufficient length.

On the other hand, in a case in which the flange part 23 or 33 of the inner or outer bobbin 20 or 30 has an insufficient length to thereby have a difficulty in securing the creepage distance with only the length of the flange part 23 or 33, the transformer 100 according to the present embodiment includes the insulating rib 37 additionally formed on the flange part 33 of the outer bobbin 30, whereby the creepage distance may be secured.

Therefore, the plurality of insulating ribs 37 formed on the outer bobbin 30 may have varied protrusion distances as long as the creepage distance is secured. When the plurality of insulating ribs 37 are formed on the outer bobbin 30, the respective insulating ribs 37 may have different protrusion distances.

The outer bobbin 30 according to the present embodiment may include at least one coupling groove 38 such that the inner bobbin 20 inserted into the through-hole 31 may be fixed thereto.

The number, position and shape of the coupling grooves 38 correspond to those of the fitting protrusions 28 formed on the inner bobbin 20.

In the present embodiment, the fitting protrusions 28 are formed to be maximally spaced apart from each other at both distal ends of the outer peripheral edges of the flange part 23 of the inner bobbin 20, respectively. Therefore, the coupling grooves 38 are formed to be maximally spaced apart from each other at both ends of an inner peripheral surface of the through-hole 31 of the outer bobbin 30.

Particularly, the coupling groove 38 is formed while vertically traversing the through-hole 21 at a predetermined width in the inner peripheral surface of the through-hole 31 of the outer bobbin 30, and includes a fitting groove 38*a* and a guide groove 38*b*.

The fitting groove 38*a* may have a shape corresponding to that of the fitting protrusion 28 in an upper end surface of the outer bobbin 30. The fitting protrusion 28 of the inner bobbin 20 is fitted into the fitting groove 38*a*, whereby the inner and outer bobbins 20 and 30 are coupled to each other. Therefore, when the fitting protrusion 28 is inserted into the fitting groove 38*a*, the inner bobbin 20 is completely inserted into the through-hole 31 of the outer bobbin 30, and accordingly, the inner bobbin 20 and the outer bobbin 30 are integrated with each other.

The guide groove 38*b* is formed from a lower end surface of the outer bobbin 30 to a lower end portion of the fitting groove 38*a* and has an inclined bottom surface. That is, the guide groove 38*b* has a maximum depth at the lower end surface of the body part 22 and a minimum depth at a position adjacent to the fitting groove 38*a*. The guide groove 38*b* is used as a path through which the fitting protrusion 28 moves when the inner bobbin 20 is coupled to the outer bobbin 30.

A process of coupling the fitting protrusion 28 and the coupling groove 38 described above will be described.

When the inner bobbin 20 is coupled to the outer bobbin 30, a side of the inner bobbin 20 at which the support jaw 29 is formed is first inserted into the through-hole 31 of the outer bobbin 30. Here, the fitting protrusion 28 of the inner bobbin 20 is coupled to the coupling groove 38 (that is, the fitting groove) of the outer bobbin 30 to be slightly inserted thereinto.

Then, a side of the inner bobbin 20 at which the terminal connection part 24 is formed is pushed into the through-hole 31 of the outer bobbin 30. At this time, the fitting protrusion 28 at the side of the inner bobbin 20 at which the terminal connection part 24 is formed enters the guide groove 38*b* through the lower end surface of the body part 32 of the outer bobbin 30. Here, as described above, since the guide groove 38*b* has the maximum depth in the lower end surface of the body part 22, the fitting protrusion 28 may be easily inserted into the guide groove 38*b*.

As the inner bobbin 20 is pushed into the through-hole 31 of the outer bobbin 30, the fitting protrusion 28 moves upwardly of the body part 22 of the outer bobbin 30 along the guide groove 38*b* to thereby be inserted into the fitting groove 38*a*. Here, the terminal connection part 24 of the inner bobbin 20 prevents the inner bobbin 20 from moving upwardly of the outer bobbin 30 while contacting the lower end surface of the outer bobbin 30.

Therefore, the fitting protrusion 28 fitted into the fitting groove 38*a* is caught by a step dividing the guide groove 38*b* and the fitting groove 38*a*, such that the downward movement of the inner bobbin 20 is suppressed. In addition, the support jaw 29 and the terminal connection part 24 support the lower end surface of the outer bobbin 30, such that the upward movement of the inner bobbin 20 is suppressed. Therefore, after the coupling between the inner and outer bobbins 20 and 30 is completed, the inner bobbin 20 may not be easily separated from the outer bobbin 30.

In the bobbin part according to the present embodiment configured as described above, the external connection terminals 26 provided in the inner bobbin 20 and the external connection terminals 36 provided in the outer bobbin 30 are disposed to be maximally spaced apart from each other. Therefore, when the inner bobbin 20 is coupled to the outer bobbin 30, the side of the inner bobbin 20 at which the terminal connection part 24 is formed is positioned in a direction opposite to a direction in which the terminal connection part 34 of the outer bobbin 30 is formed.

Therefore, the external connection terminals 36 of the outer bobbin 30 and the external connection terminals 26 of the inner bobbin 20 are disposed to protrude in opposite directions. Therefore, in the transformer 100 according to the present embodiment, the external connection terminals 26 of the primary coil 50*a* are sufficiently spaced apart from the external connection terminals 36 of the secondary coil 50*b*, whereby an insulation distance between the primary and secondary coils may be easily secured.

In addition, in the bobbin part 10 according to the present embodiment, when the inner bobbin 20 is coupled to the outer bobbin 30, insulation properties between the coil 50 wound around the inner winding part 20*a* and the coil 50 wound around the outer winding part 30*a* may be secured through the body part 22 of the inner bobbin 20. Therefore, the coil 50 wound around the inner winding part 20*a* and the coil 50 wound around the outer winding part 30*a* may be disposed to be maximally adjacent to each other.

However, in order to secure the output characteristics of the transformer 100 or an insulation distance, the outer surface of the coil 50 wound around the inner winding part 20*a* may also be spaced apart from the inner peripheral surface of the through-hole 21 of the outer bobbin 30 by a predetermined interval.

Further, in the bobbin part 10 according to the present embodiment, when the inner bobbin 20 and the outer bobbin 30 are coupled to each other, the flange part 23 of the inner bobbin 20 and the flange part 33 of the outer bobbin 30 are positioned on the same plane. That is, the bobbin part 10 in which the inner bobbin 20 and the outer bobbin 30 are coupled to each other includes partially protruding parts at which only the insulating ribs 27 and 37 or the terminal connection parts 24 and 34 are formed, and has an overall flat thin shape. Therefore, it may be easily used in thin display devices.

Further, the bobbin part 10 in the present embodiment is configured of a single outer bobbin 30 and a single inner bobbin 20 by way of example; however, the present invention is not limited thereto. A plurality of bobbins may be inserted into a single outer bobbin. For example, the bobbin part 10 may be configured so that a separate bobbin (hereinafter, referred to as an intermediate bobbin) having a similar shape to that of the outer bobbin 30 is inserted into the through-hole 31 of the outer bobbin 30 and the inner bobbin 20 is inserted into a through-hole of the intermediate bobbin, and the core 40 may be inserted into the through-hole 21 of the inner bobbin 20.

In this case, the primary coil 50*a* (or the secondary coil) may be wound around two individual bobbins, i.e., any two of the inner bobbin, the intermediate bobbin, and the outer bobbin.

The individual bobbins 20 and 30 of the bobbin part 10 according to the present embodiment configured as described above may be easily manufactured by an injection molding method. However, the present invention is not limited thereto. The individual bobbins 20 and 30 may be manufactured by various methods such as a press processing method, or the like. In addition, the individual bobbins 20 and 30 of the bobbin part 10 according to the present embodiment may be made of an insulating resin material and a material having high heat resistance and high voltage resistance. As a material of the individual bobbins 20 and 30, polyphenylenesulfide (PPS), liquid crystal polyester (LCP), polybutyleneterephthalate (PBT), polyethyleneterephthalate (PET), phenolic resin, and the like, may be used.

The coil 50 includes the primary coil 50*a* and the secondary coil 50*b*.

The primary coil 50*a* is wound around the inner wining part 20*a* formed in the inner bobbin 20.

Further, the primary coil 50*a* according to the present embodiment may include a plurality of coils 50 electrically insulated from each other and wound around a single inner winding part 20*a*. That is, in the transformer 100 according to the present embodiment, the primary coil 50*a* is configured of the plurality of coils 50, such that various voltages may be applied and be drawn through the secondary coil 50*b* correspondingly.

To this end, the individual coils 50 of the primary coil 50*a* may have different thicknesses and different turn amounts. In addition, as the primary coil 50*a*, a single strand of wire may be used or a Ritz wire formed by twisting several strands may be used.

The lead wire of the primary coil 50*a* is connected to the external connection terminal 26 provided in the inner bobbin 20.

The secondary coil 50*b* is wound around the outer winding part 30*a* formed in the outer bobbin 30.

Similar to the above-mentioned primary coil 50*a*, the secondary coil 50*b* may also include a plurality of coils 50 electrically insulated from each other. An example thereof is shown in FIG. 3. The lead wire of the secondary coil 50*b* is connected to the external connection terminal 36 provided in the outer bobbin 30.

Meanwhile, the present embodiment describes a case in which the primary coil 50*a* is wound around the inner winding part 20*a* and the secondary coil 50*b* is wound around the outer winding part 30*a* by way of example; however, the present invention is not limited thereto. Modifications and variations may be made as long as a user may draw a desired voltage. For example, the primary coil 50*a* may be wound around the outer winding part 30*a* and the secondary coil 50*b* may be wound around the inner winding part 20*a*.

The core 40 is inserted into the through-hole 21 formed in the inner portion of the inner bobbin 20. The core 40 according to the present embodiment is configured in a pair. The pair of cores 40 may be inserted into the through-hole 21 of the inner bobbin 20 to thereby be connected to each other while facing each other. As the core 40, an 'EE' core, an 'EI' core, or the like, may be used.

The core 40 may be made of Mn—Zn-based ferrite having higher permeability, lower loss, higher saturation magnetic flux density, higher stability, and lower production costs, as compared to other materials. However, the shape or material of the core 40 is not limited.

Figure 8:
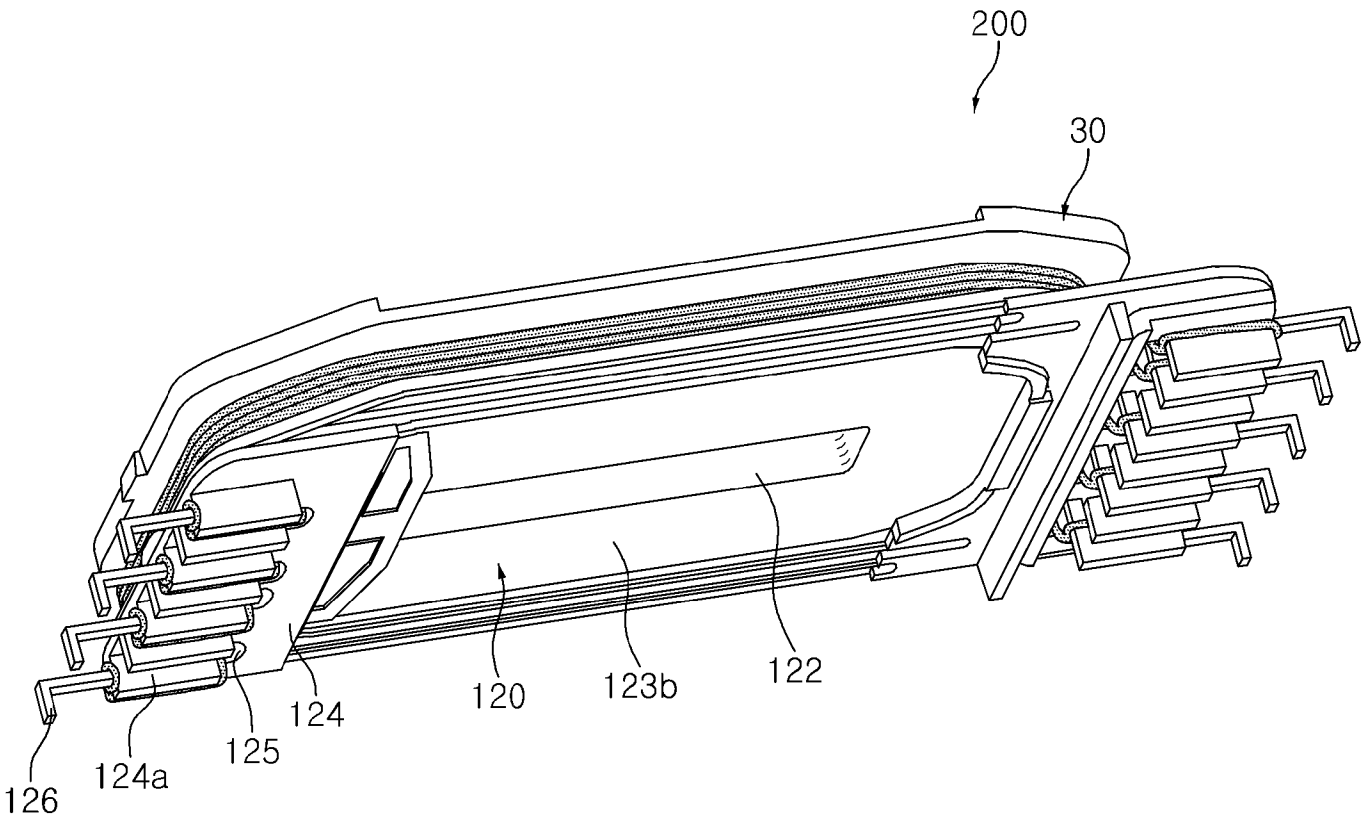
FIG. 8 is a schematic perspective view showing a transformer according to another embodiment of the present invention.

FIG. 8 is a schematic perspective view showing a transformer according to another embodiment of the present invention. A transformer 200 according to the present embodiment has a similar configuration to that of the transformer 100 of FIG. 1 according to the above-mentioned embodiment and is different therefrom only in the configuration of a terminal connection part 124 of an inner bobbin 120. Therefore, a detailed description of components configured identically to those of the above-mentioned embodiment will be omitted, and the configuration of the terminal connection part 124 of the inner bobbin 120 will be mainly described.

Referring to FIG. 8, the terminal connection part 124 of the inner bobbin 120 according to the present embodiment protrudes from a lower flange part 123*b* in an outer diameter direction of a body part 122 and protrudes by a length corresponding to the outer peripheral surface of the lower flange part 33*b* of the outer bobbin 30.

In addition, the lower flange part 33*b* of the outer bobbin 30 according to the present embodiment may be entirely flat without including an insulating rib thereon. Therefore, the inner bobbin 120 may be coupled to the outer bobbin 30 while an upper surface of the terminal connection part 124 contacts the lower surface of the lower flange part 33*b* of the outer bobbin 30. As a result, an increase in the thickness of the transformer 200 may be minimized.

The terminal connection part 124 may include guide protrusions 124*a* and lead grooves 125, similar to the terminal connection part 34 of the outer bobbin 30.

A plurality of guide protrusions 124*a* protrude from a lower surface of the terminal connection part 124 in a downward direction of the body part 122 in parallel with each other. The guide protrusion 124*a* is provided to guide a lead wire of the coil 50 wound around the outer winding part so that the lead wire may be easily connected to an external connection terminal 126. Therefore, the guide protrusion 134*a* may protrude beyond a diameter of the lead wire of the coil 50 so as to firmly guide the coil 50.

The lead groove 125 may be formed in a space between the guide protrusions 124*a* and be used as a route through which the lead wire of the coil 50 wound around the outer winding part moves to the lower surface of the terminal connection part 124.

Due to the configuration of the terminal connection part 124 as described above, the lead wire of the coil 50 wound around the inner winding part moves to a lower portion of the inner bobbin 120 via the lead groove 125 and is then electrically connected to the external connection terminal 126 through the space between the guide protrusions 124*a*.

The external connection terminals 126 are connected to the terminal connection part 124 so that they protrude from the terminal connection part 124 in the downward direction or the outer diameter direction of the body part 122. Particularly, the external connection terminal 126 according to the present embodiment may be connected to the terminal connection part 124 while corresponding to the outer peripheral edge of the lower flange part 33*b* of the outer bobbin 30. However, the present invention is not limited thereto, and various modifications may be made. For example, the terminal connection part 124 may protrude beyond the outer peripheral surface of the lower flange part 33*b* of the outer bobbin 30 in order to secure insulation properties between the external connection terminal 126 of the inner bobbin 120 and the coil 50 wound around the outer bobbin 30.

As described above, in the transformer 200 according to the present embodiment, since the external connection terminal 126 of the inner bobbin 120 protrudes outwardly of the outer bobbin 30, insulation properties between the external connection terminal 126 of the inner bobbin 120 and the external connection terminal 36 of the outer bobbin 30 may be secured. In addition, when the transformer 200 is mounted on a substrate (not shown), it may be easily mounted thereon.

Meanwhile, the configuration of the transformer 200 according to the present embodiment may also be easily applied to a case in which at least two inner bobbins 120 are provided. That is, as described above, when the bobbin part 10 is configured so that the intermediate bobbin is inserted into the inner portion of the outer bobbin 30 and the inner bobbin 120 is also inserted into the inner portion of the intermediate bobbin, the primary coil (or the secondary coil) may be wound around a maximum of the two individual bobbins.

When the primary coil (or the secondary coil) is wound around the two individual bobbins as described above, the external connection terminals of the corresponding individual bobbins may be disposed in the same direction. That is, in the transformer 200 according to the present embodiment, the external connection terminal 126 having the primary coil connected thereto and the external connection terminal 36 having the secondary coil connected thereto are disposed to be maximally spaced from each other. However, when the same primary coil are wound around a different individual bobbin (that is, the intermediate bobbin), the external connection terminal of the corresponding individual bobbin may be disposed in parallel to the external connection terminal of the inner bobbin 120 having the primary coil wound therearound.

The transformer according to the embodiment of the present invention as described above has a structure in which a plurality of individually divided bobbins (for example, the inner and outer bobbins) are provided and these bobbins are coupled to each other. Therefore, the transformer may be completed by winding the coils around the individual bobbins, respectively, and then coupling the individual bobbins to each other. As a result, a process of producing the transformer may be automated.

In addition, the transformer according to the embodiment of the present invention has a significantly reduced thickness. Therefore, it may be easily used in thin display devices.

Furthermore, in the transformer according to the embodiment of the present invention, the creepage distance between the coils wound around the inner and outer bobbins may be secured based on the number, the protrusion distance, or the like, of the insulating ribs, thereby securing insulation properties while minimizing the size of the transformer.

Meanwhile, the transformer according to the embodiments of the present invention as described above is not limited to the above-mentioned exemplary embodiments but may be variously modified. For example, although the above-mentioned embodiments describe a case in which adhesion between the inner and outer bobbins is secured using the fitting protrusion and the fitting groove, the present invention is not limited thereto. A support part protrudes from the outer peripheral edge of the inner bobbin or the inner peripheral edge of the outer bobbin, such that it may secure adhesion between the inner and outer bobbins while supporting the inner and outer bobbins. That is, in the transformer according to the present embodiment, various configurations may be employed as long as the adhesion between the inner and outer bobbins may be secured.

In addition, although the above-mentioned embodiments describe a case in which the fitting protrusion is formed on the inner bobbin and the coupling groove is formed in the outer bobbin, the fitting protrusion may be formed on the inner peripheral surface of the through-hole of the outer bobbin and the coupled groove may be formed in the outer peripheral edge of the inner bobbin.

In addition, the above-mentioned embodiments describe a case in which the bobbin has a rectangular shape having a curved edge. However, the present invention is not limited thereto. The bobbin may have various shapes such as a circular shape, a cylindrical shape, or the like, as long as a desired voltage may be drawn therefrom.

In addition, although the present embodiment describes the transformer used in the display device by way of example, the present invention is not limited but may be widely applied to a transformer or an electronic device including an external connection terminal to which a lead wire of a coil is connected.

As set forth above, a transformer according to embodiments of the present invention has a structure in which a plurality of individually divided bobbins (for example, the inner and outer bobbins) are provided and these bobbins are coupled to each other. Therefore, the transformer may be completed by winding coils around the individual bobbins, respectively, and then coupling the individual bobbins to each other. As a result, a process of producing the transformer may be automated.

In addition, in the transformer according to the embodiments of the present invention, when the inner and outer bobbins are coupled to each other, a flange part of the inner bobbin and a flange part of the outer bobbin are positioned on the same plane. Therefore, the transformer has a generally flat thin shape, whereby it may be easily used in a thin display device, or the like.

Further, in the transformer according to the embodiments of the present invention, external connection terminals of the inner bobbin protrude outwardly of the outer bobbin. Therefore, insulation properties between the external connection terminals of the inner bobbin and external connection terminals of the outer bobbin may be further secured. In addition, when the transformer is mounted on a substrate, it may be easily mounted thereon.

While the present invention has been shown and described in connection with the embodiments, it will be apparent to those skilled in the art that modifications and variations can be made without departing from the spirit and scope of the invention as defined by the appended claims.

What is claimed is:

1. A transformer, comprising:

a bobbin part including a plurality of bobbins, each including:

a pipe shaped body part having a though-hole formed in an inner portion thereof, a flange part vertically protruding outwardly from both ends of the body part, and a terminal connection part protruding from one side of a lower flange part formed at a lower end of the body part and having external connection terminals connected thereto;

a core inserted into the through-hole of the plurality of bobbins to thereby form a magnetic path; and a coil part including coils each wound around the plurality of bobbins, wherein:

the bobbin part includes an outer bobbin and an inner bobbin inserted into the through-hole of the outer bobbin to thereby be coupled thereto, and the terminal connection part of the inner bobbin protrudes in an outer diameter direction thereof, each of the terminal connection parts respectively included in the inner and outer bobbins includes a lead groove formed in a space between the external connection terminals, and the coils lead to a lower portion of the bobbin part while passing through the lead groove, the terminal connection art of each of the plurality of bobbins includes guide protrusions formed on a lower surface thereof and protruding in parallel with the external connection terminals, and lead wires of the coils are disposed along the guide protrusions to thereby be connected to the external connection terminals.

2. The transformer of claim 1, wherein the terminal connection part of the inner bobbin protrudes by a length corresponding to a width of the flange part of the outer bobbin.

3. The transformer of claim 1, wherein the inner bobbin is inserted into the through-hole of the outer bobbin to thereby be coupled thereto such that the flange part of the inner bobbin and the flange part of the outer bobbin are disposed on the same plane.

4. The transformer of claim 1, wherein at least one of the plurality of bobbins includes the flange part having a width larger than a thickness of the body part.

5. The transformer of claim 1, wherein the inner bobbin is coupled to the outer bobbin such that the external connection terminals of the inner bobbin and the external connection terminals of the outer bobbin are opposed.

6. The transformer of claim 1, wherein at least one of the lead wires of the coils is connected to the external connection terminals through a space between two adjacent guide protrusions.

7. The transformer of claim 1, wherein the terminal connection part of the outer bobbin includes a spacing block formed between the guide protrusions and the inner bobbin and protruding perpendicular to the guide protrusions.

8. The transformer of claim 1, wherein the coil part includes a primary coil wound around the inner bobbin and a secondary coil wound around the outer bobbin, and at least one of the primary and secondary coils includes a plurality of coils electrically insulated from each other.

* * * * *